US010049647B1

(12) United States Patent
Powers

(10) Patent No.: US 10,049,647 B1
(45) Date of Patent: Aug. 14, 2018

(54) GUITAR FINGERBOARD

(71) Applicant: TAYLOR-LISTUG, INC., El Cajon, CA (US)

(72) Inventor: Andrew Taylor Powers, Carlsbad, CA (US)

(73) Assignee: TAYLOR-LISTUG, INC., El Cajon, CA (US)

( * ) Notice: Subject to any disclaimer, the term of this patent is extended or adjusted under 35 U.S.C. 154(b) by 0 days.

(21) Appl. No.: 15/666,273

(22) Filed: Aug. 1, 2017

(51) Int. Cl.
*G10D 3/06* (2006.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 3/06; G10D 1/08
See application file for complete search history.

(56) References Cited

U.S. PATENT DOCUMENTS 1,290,177 A * 1/1919 Grimson ..... G10D 3/06 84/314 R
5,852,249 A * 12/1998 Steinberg ..... G10D 3/06 84/293
5,864,073 A * 1/1999 Carlson ..... G10D 3/06 84/267
5,990,396 A * 11/1999 Lasner ..... G10D 3/06 84/267
6,034,308 A * 3/2000 Little ..... G10D 1/085 84/267
6,114,618 A * 9/2000 Anke ..... G10D 3/06 84/314 R
9,478,198 B1 * 10/2016 Daley ..... G10D 1/085
9,524,704 B2 * 12/2016 McSwain ..... G10D 1/08
9,679,543 B2 * 6/2017 Daley ..... G10D 3/06

OTHER PUBLICATIONS

Mangore, Bellucci Guitars—"Josep Mercader/Bellucci Radius, New Option on Bellucci Custom Guitars" excerpt, date unknown, 6 pages.

* cited by examiner

*Primary Examiner* — Robert W Horn
(74) *Attorney, Agent, or Firm* — Patterson & Sheridan, LLP

(57) ABSTRACT

A stringed instrument includes a body; an elongated neck; and a headstock, wherein the neck has a fingerboard on a top side with spaced-apart frets disposed perpendicularly along its length and extending from a first to a second side of the fingerboard. A top surface of the frets forms a fret plane having a first and second convex radiused surface, the first surface extending from an upper edge of the plane towards a center thereof and the second surface extending from a lower edge of the plane to a center thereof. In one embodiment, the first surface forms a smaller radius and the second surface forms a larger radius.

14 Claims, 8 Drawing Sheets

GUITAR FINGERBOARD

BACKGROUND OF THE INVENTION

Field of the Invention

Embodiments of the present invention generally relate to a stringed instrument. More particularly, the invention relates to a fingerboard for a fretted, stringed instrument.

Description of the Related Art

Many stringed instruments utilize a fingerboard (also known as a fretboard on fretted instruments). The fingerboard is a thin, long strip of material, usually wood, that is laminated to the front of the neck of an instrument. The strings run over the fingerboard, between a nut at one end and the bridge at an opposite end. Some stringed instruments, like guitars utilize a fingerboard having frets disposed perpendicular to the long axis of the board. The frets are raised strips of hard material perpendicular to the strings, which the player presses the strings against to stop (and essentially shorten) the strings. On modern guitars, frets are typically made of metal. Frets let the player stop the string consistently in the same place, which enables the musician to play notes with the correct intonation. In some instances players "bend" the fretted strings, displacing them in the direction of the center of the fingerboard in order to increase the tension on the string tighter and cause the pitch to rise. Most fingerboards have a single radius to permit ease of playing. Because of the radius, bending a string can increase its height on the fingerboard relative to a point where the string is suspended at the bridge. This increase in height can reduce the clearance between the fretted string and an adjacent fret preventing the fretted string from "sounding".

What is needed is a fingerboard design that reduces the likelihood of interference when a string is bent yet still offers the comfort of a radiused fingerboard.

SUMMARY OF THE INVENTION

The present invention generally comprises a stringed instrument having a body; an elongated neck; and a headstock, wherein the neck has a fingerboard on a top side with spaced-apart frets disposed perpendicularly along its length and extending from a first to a second side of the fingerboard. A top surface of the frets forms a fret plane having a first and second convex radiused surface, the first surface extending from an upper edge of the plane towards a center thereof and the second surface extending from a lower edge of the plane to a center thereof. In one embodiment, the first surface forms a smaller radius and the second surface forms a larger radius.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to stringed and fretted instruments. More particularly, the invention relates to a guitar fingerboard wherein the fingerboard has two independent radii extending across its width.

Figure 1:
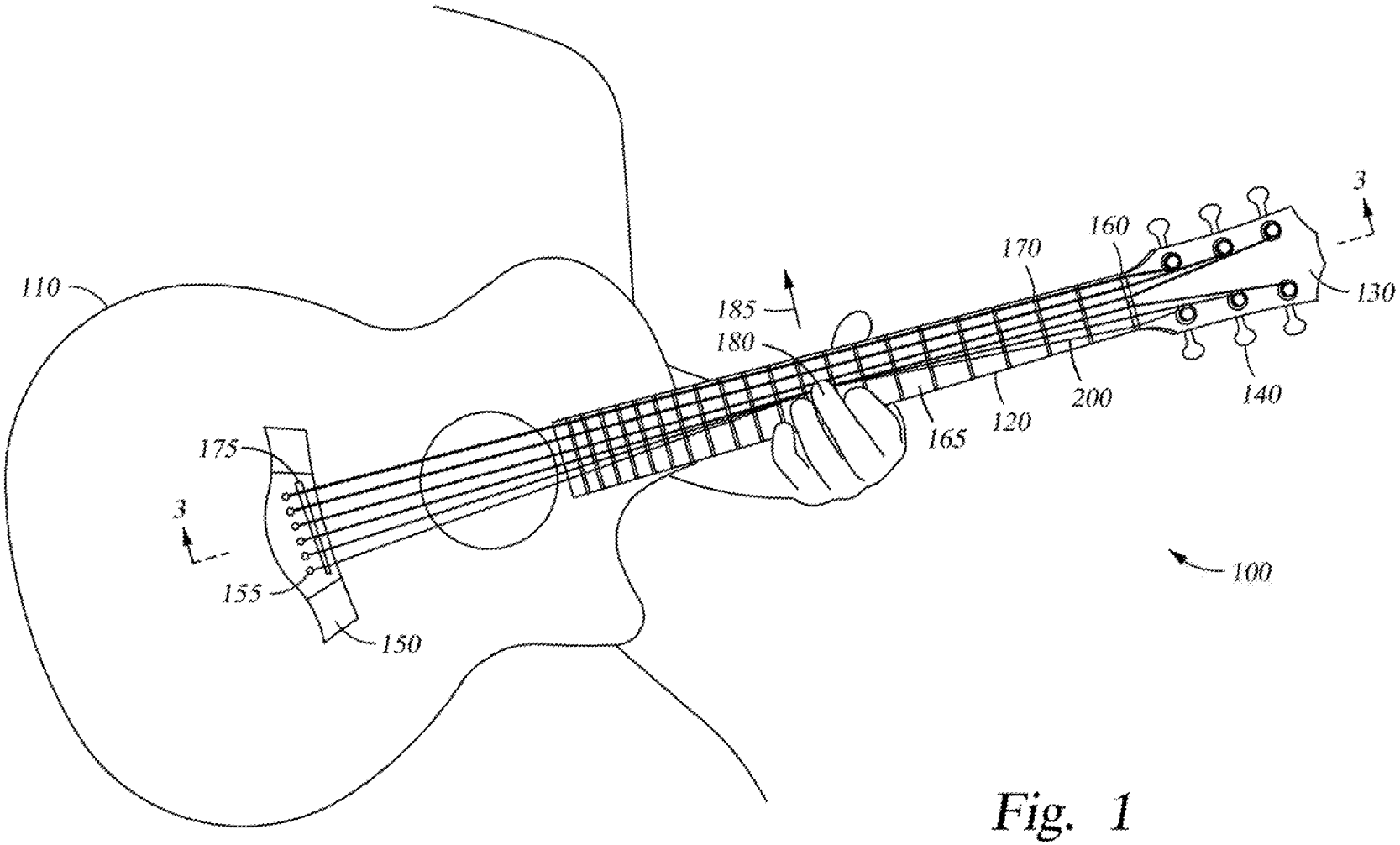
FIG. 1 is an illustration of an acoustic guitar in the hands of a player.

FIG. 1 is an illustration of a guitar 100 in the hands of a player. In the example of FIG. 1, the guitar is an acoustic guitar wherein the top of the guitar acts as an acoustic soundboard, but elements of the present invention are equally useful when applied to an electric guitar or any other stringed instrument with fixed frets. The guitar includes a body 110, a neck 120, and a headstock 130. Strings extend from the headstock where they are tightened to a preferred tension with keys 140 to a bridge 150 where they are anchored with bridge pins 155, one for each string. A nut 160 is placed at the end of a fingerboard 165 adjacent the headstock and controls the string spacing, distance from the edge of the fingerboard and the height of the strings above a first fret 170 on the fingerboard 165. The strings are slightly splayed over their length and extend over a saddle 175 that is housed in the bridge 150. The portion of the strings that vibrates to create a sound when plucked is that portion extending between the nut 160 and saddle 175. The strings are stopped or effectively shortened when they are depressed behind a fret. In the illustration of FIG. 1, the smallest string 200 is depressed by a finger 180 of the player and in addition is "bent" or displaced (arrow 185) towards the opposite side of the fingerboard 165 to raise the pitch of a note without the necessity of fretting at a location closer to the bridge 150.

Figure 2:
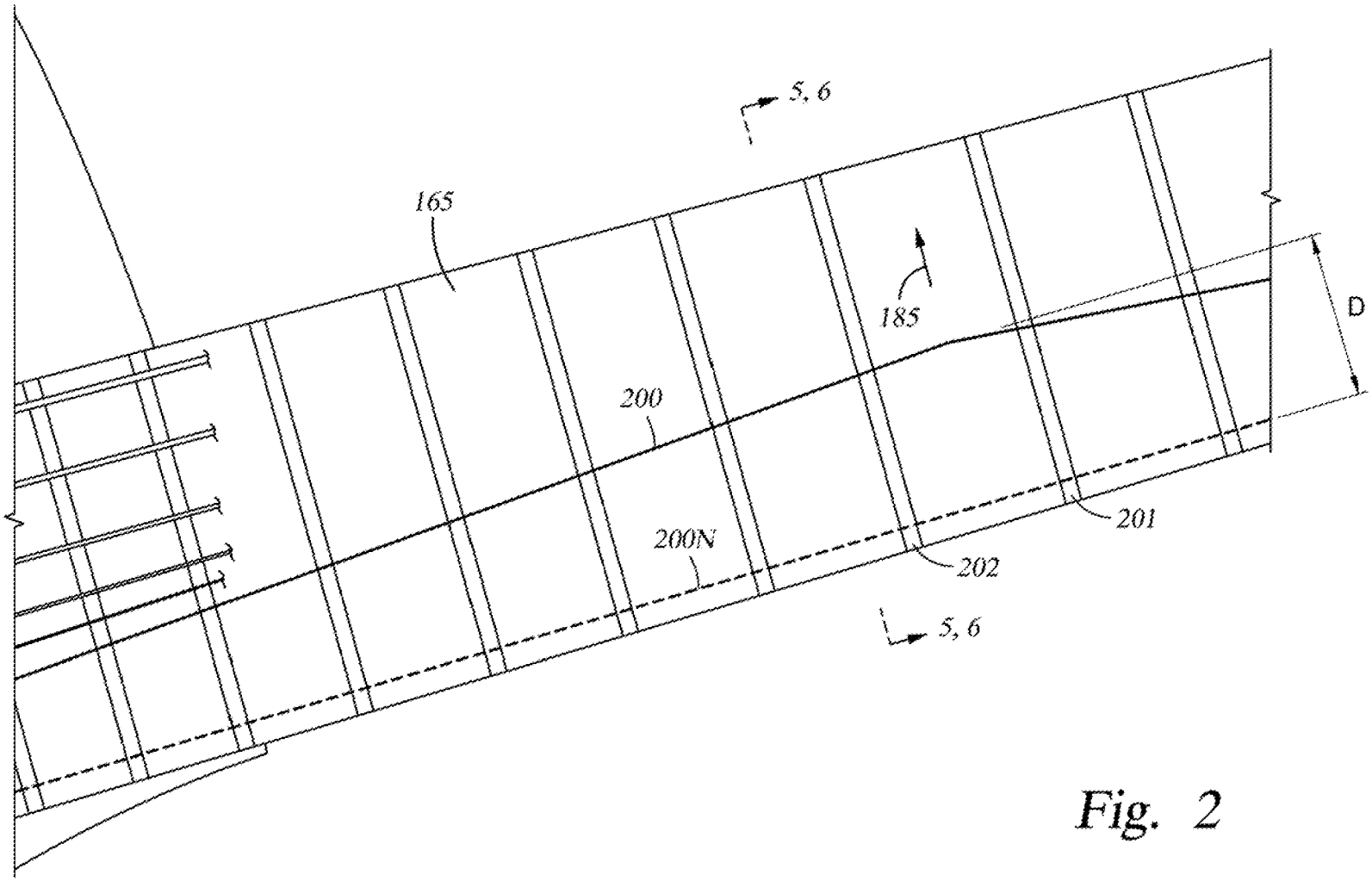
FIG. 2 is an illustration of the acoustic guitar of FIG. 1 with an enlarged view of the fingerboard and showing in particular, a string displaced towards a center of the fingerboard.

FIG. 2 is an illustration of the acoustic guitar 100 of FIG. 1 with an enlarged view of the fingerboard 165 and showing in particular, the small string 200 fretted and displaced along the fingerboard between two frets 201, 202 to a distance "D". The original or neutral position of the string is shown by dotted line 200*n*. Typically, before a string is displaced, it's fretted at a particular location between two frets, plucked, and then stretched across the fingerboard to create a rise in pitch and create a different, higher note. It will be understood, therefore, that a displaced string is one that is also fretted.

Figure 3:
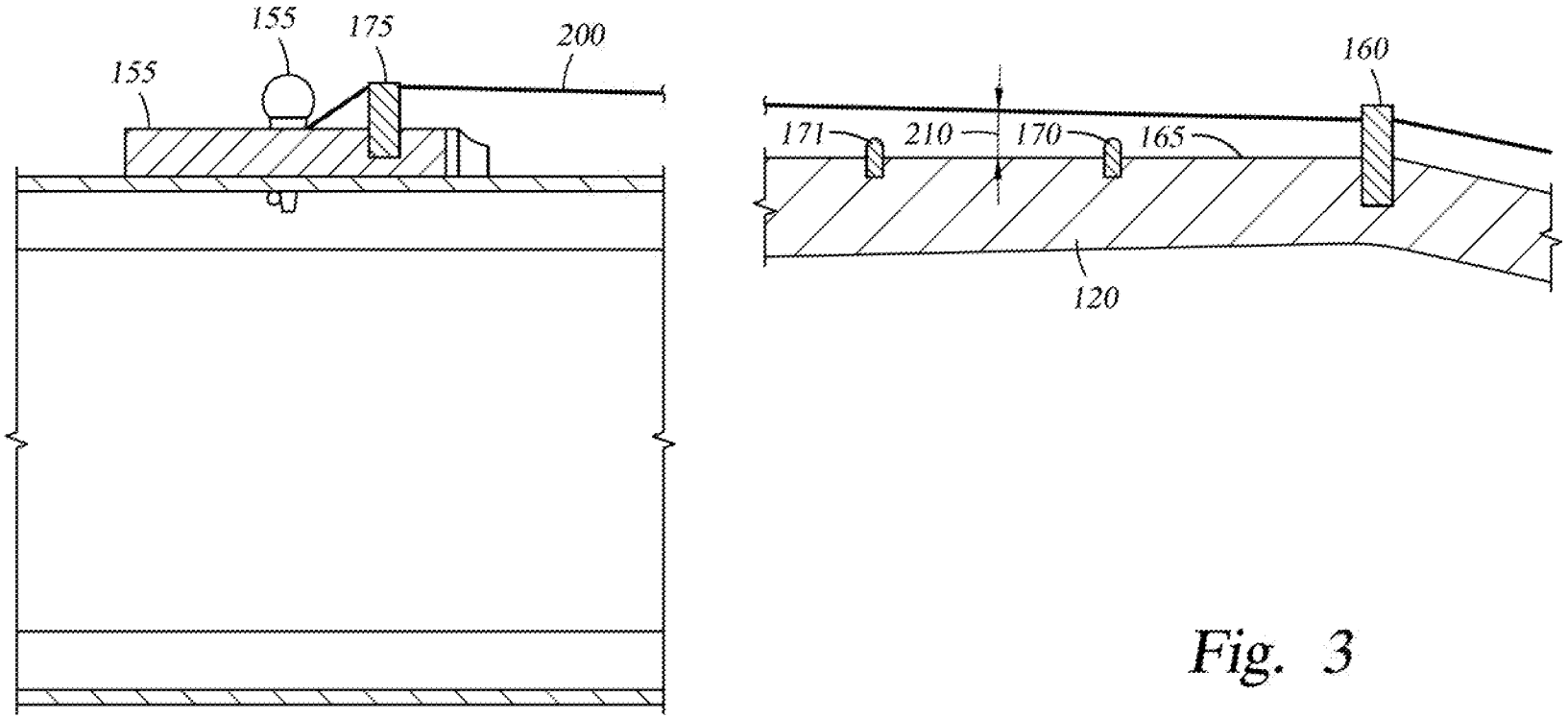
FIG. 3 is a side view, partially in section showing an angle between the guitar strings, the fingerboard and a fret plane.
Figure 4:
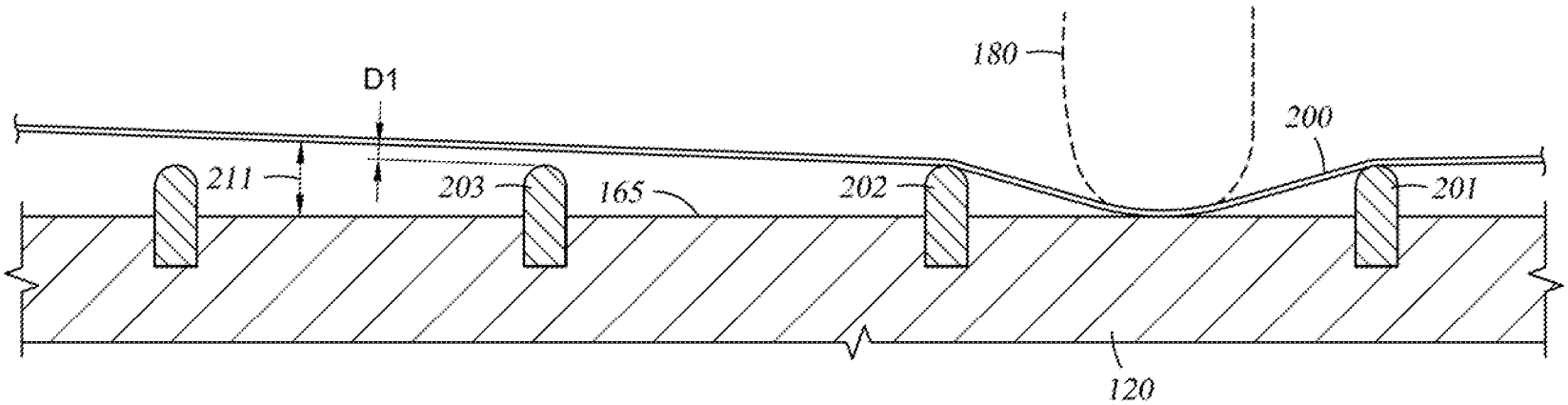
FIG. 4 is a partial section view taken along a line parallel to the long axis of the guitar neck and showing a depressed (fretted) string in a neutral position and its clearance relative to an adjacent fret.

FIG. 3 is a side view, partially in section showing an angle between a guitar string in its neutral, unfretted position and the fingerboard 165. Only a single string 200 is visible but the others (typically 6 in total) will be suspended in the same manner and at the same angle 210. At an opposite end, the strings are suspended by the saddle 175 at a higher level. The difference in height results in an increasing angle 210 as the strings extend from the headstock (not shown) to the saddle 175. Angle 210 ensures that when a string is fretted at a certain location, the adjacent fret (in the direction of the bridge) will not interfere with the vibration of the fretted string. FIG. 4 illustrates the importance of angle 210 and the clearance it provides. FIG. 4 is a partial section view taken along a line parallel to the long axis of the guitar neck and showing a depressed (fretted) string 200 and its clearance relative to an adjacent fret. As shown, the string is fretted between two frets 201, 202. In spite of the string 200 being depressed behind fret 202, an angle 211 remains between the string and an adjacent fret 203, resulting in a clearance D1.

Figure 5:
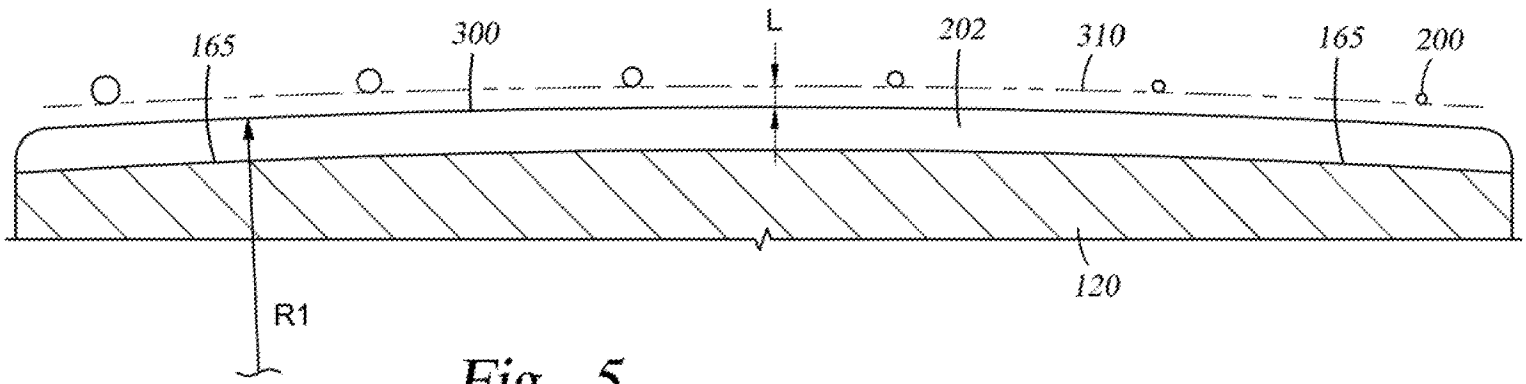
FIG. 5 is a partial section view taken along a line perpendicular to the long axis of the guitar neck and showing a radiused surface of the fingerboard and a correspondingly radiused fret plane and string plane of the guitar.

In addition to the increasing angle 210 of the unfretted strings above the fingerboard 165, the fingerboard itself is radiused to facilitate the fretting of multiple strings at once. FIG. 5 is a partial section view taken along a line perpendicular to the long axis of the guitar neck and showing a radiused surface R1 of a fret plane 300 (a line across the top edge of the frets) a correspondingly radiused fingerboard 165, and a string plane 310 formed by the strings in their neutral, unfretted position. In the prior art example shown, radius R1 is a single, symmetrical, convex radius having its apex in the center of the fingerboard 165. The uniform distance of the strings above the fret plane is shown as "L".

Figure 6:
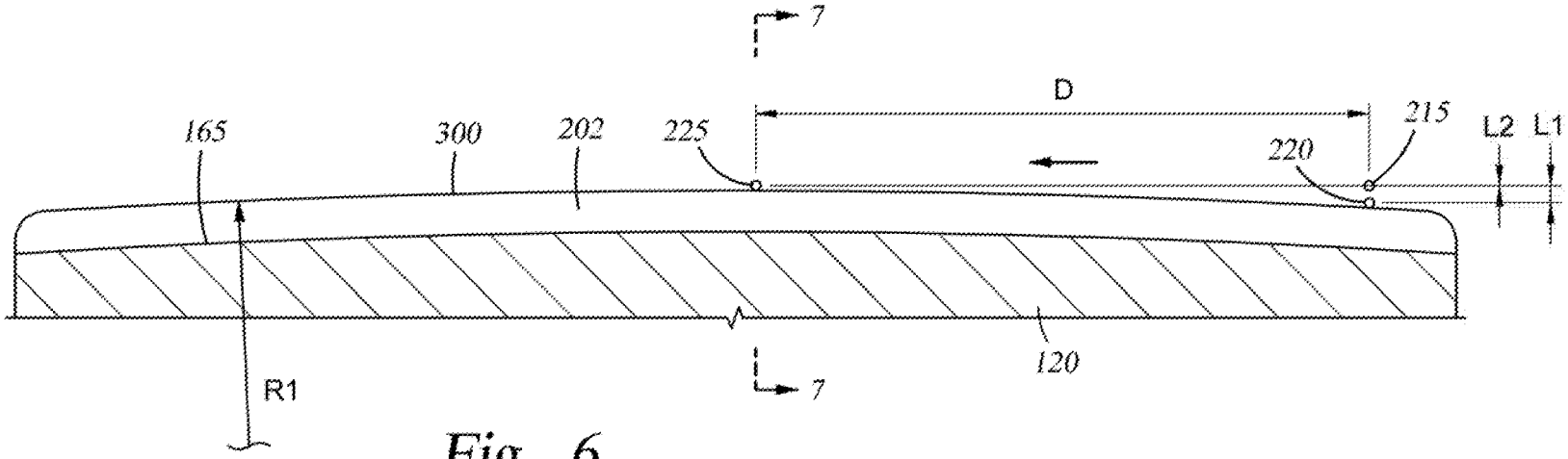
FIG. 6 is a partial section view of the guitar of FIG. 5 showing the small string of the guitar in a neutral, fretted, and displaced position.

FIG. 6 is a partial section view of the guitar of FIG. 5 showing the small string 200 of the guitar in a neutral 215, fretted 220, and displaced 225 positions. In the displaced position 225, the string 200 is shifted towards the apex of the radiused R1 fingerboard 165 and is therefore at a higher location than it would be when fretted at its neutral position 220. The result is a loss of the string angle 211 that typically prevents interference of a string with an adjacent fret. This result is shown in FIG. 7, a partial section view of like FIG. 4 but illustrating the absence in clearance D2 between the string and adjacent fret 203 when the string is displaced along the radiused R1 fingerboard 165 of the guitar (position 225, FIG. 6).

Figure 8:
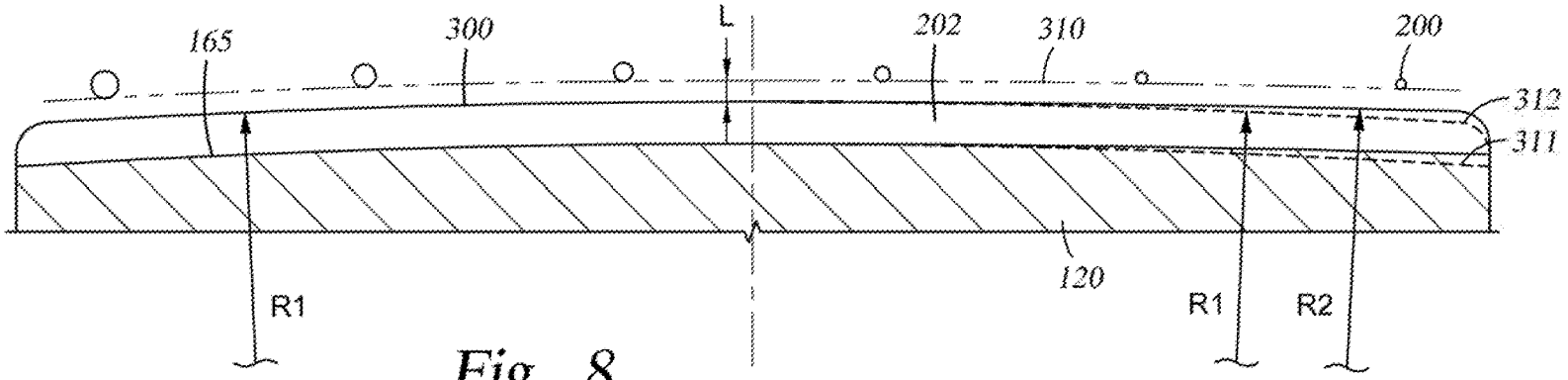
FIG. 8 is a partial section view like FIG. 5, but including an enlarged radius R2 of the fingerboard, fret plane and string plane in the area of the smaller strings.

FIG. 8 is a partial section view like FIG. 5, but includes an enlarged radius R2 formed on the fingerboard 165, and reflected in the fret plane 300 and string plane 310 in the area of the smaller strings. The original radius R1 of both the fingerboard and fret plane is shown in dotted lines 311, 312. The larger radius R2 effectively makes the slope of the fingerboard towards its centerline more gradual. While the larger radius R2 is formed under the smaller strings (that are most likely to be displaced by a guitar player), the area of the fingerboard under the larger strings retains its original, smaller radius R1 to ensure ease of fretting multiple strings at once.

Figure 9:
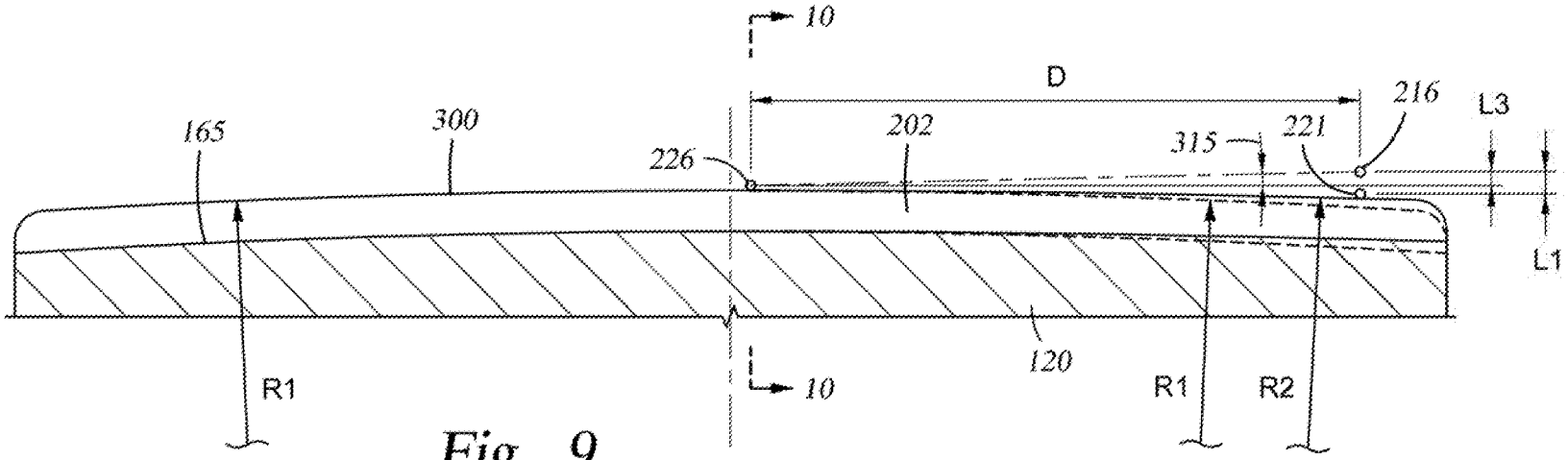
FIG. 9 is a partial section view like FIG. 6, but showing the showing the small string of the guitar in an unfretted, fretted and displaced position along the enlarged radiused portion R2 of the fingerboard.

FIG. 9 is the partial section view of FIG. 8 but illustrates the location of the small string in its neutral 216, fretted 221 and displaced 226 positions. L1 is the difference in height between the small string in its neutral position 216 and fretted position 211. L3 is the difference in height between the small string 200 in its neutral and displaced 226 positions. Also illustrated in FIG. 9 is an angle 315 between the fingerboard 165 and string plane 310 created by the larger radius R2. As can be appreciated by comparing R1 and R2, the larger radius results in a more gradual slope and gradual increase in height as a string is displaced, thereby reducing the likelihood of interference with an adjacent fret when the string is urged to a displaced position.

Figure 7:
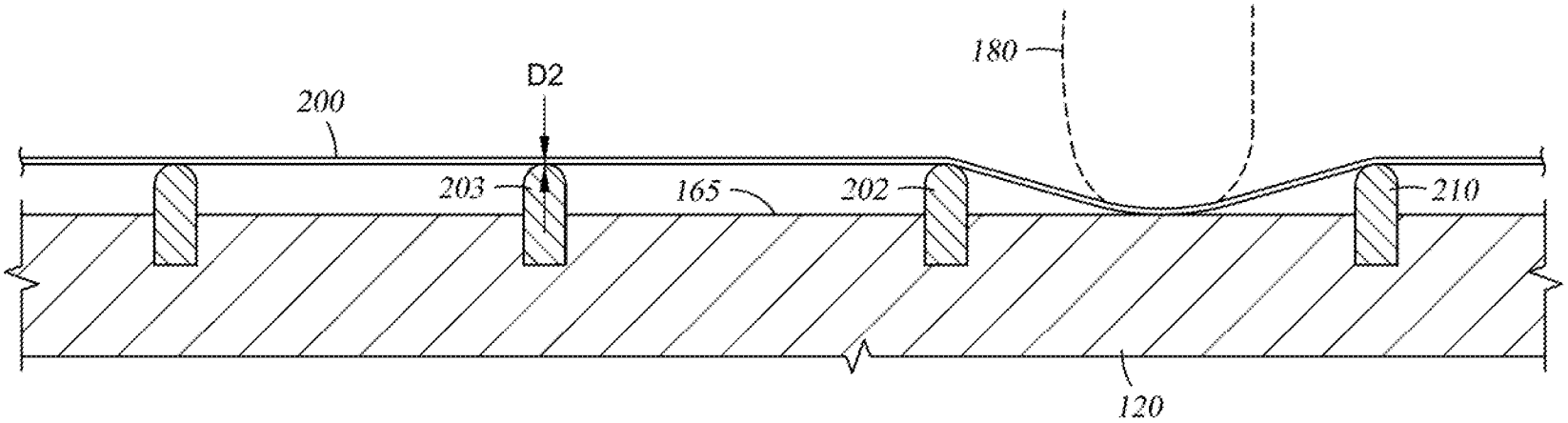
FIG. 7 is a partial section view of the guitar of FIG. 6 illustrating the absence in clearance when the fretted string is displaced along the fingerboard of the guitar.
Figure 10:
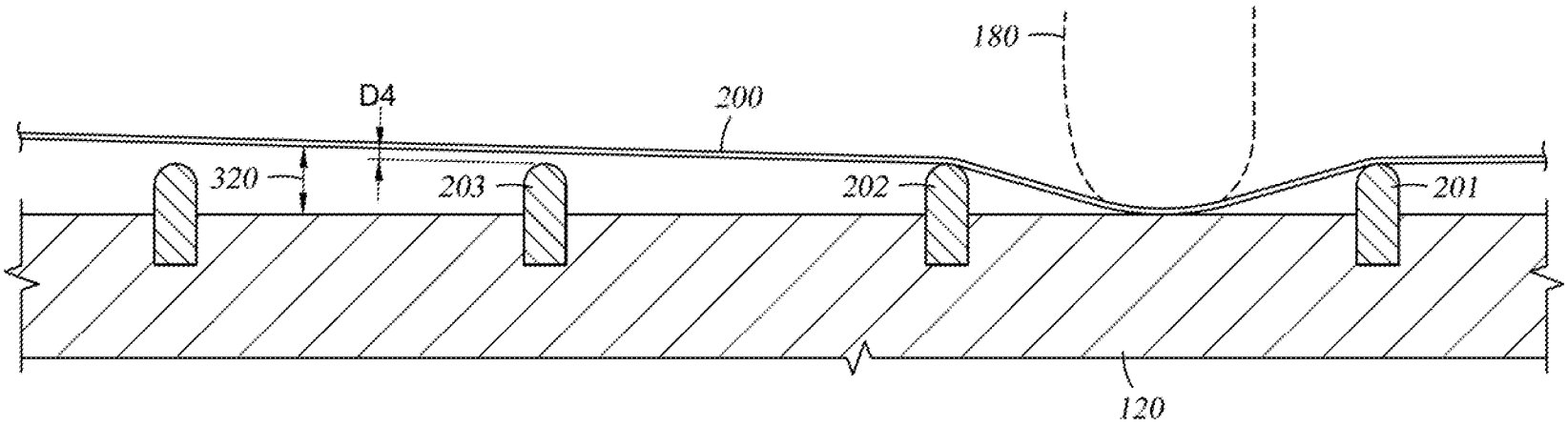
FIG. 10 corresponds to FIG. 7 but illustrates the clearance maintained between a displaced string and an adjacent fret when the enlarged radius R2 is utilized.

FIG. 10 a partial section view like FIG. 7, but shows the small string 200 in a displaced position on the fingerboard having the enlarged radius R2. A comparison of FIGS. 7 and 10 illustrates that unlike the prior art, single radius R1 fingerboard, the fingerboard having the larger R2 radius in the area of the small strings permits a string to be displaced while maintaining an angle 320 that is adequate to ensure a clearance D4 between the displaced string and an adjacent fret 203.

In one example, a guitar fingerboard 165 has a first smaller radius R1 in the area of the larger strings and a larger radius R2 in the area of the smaller strings as shown in FIGS. 8 and 9. A fret plane and string plane have identical profiles so that when the strings are in their neutral, unfretted position, the clearance between each string and the fret plane under the string is the same. When the guitar is played, the fact that the fingerboard is radiused all the way across facilitates the fretting or barring of several strings at once. However, when a smaller string 200 is displaced after being fretted, the more gradual slope of the larger radius R2 lessens the tendency of the string to reach a height on the fret plane where an adjacent fret interferes with the string. The difference between the two convex shapes can also be expressed in terms of rise/run. The larger radius R2 in the area of the smaller strings has a smaller rise/run ratio than the other side of the fret plane with the original R1 radius in the area of the larger strings.

The amount of curvature of a fingerboard is commonly expressed as a radius, indicating the cross sectional shape is a portion of a circle having a radius of the given measurement. Measured in inches, guitar fingerboards are seen in a range having an extreme curvature of 6 inches, to a flatter extreme curvature of 30 inches. A common radius measurement is between 9.5 inches and 15 inches. While a preferred embodiment of the present invention would use a radius having a measurement of 10 inches under the larger strings and flatter radius of 15 inches under the smaller strings, any combination of two radii may be used effectively, so long as the portion of fingerboard under the larger strings is more curved than the portion beneath the smaller strings. Furthermore, the curvature of the fingerboard does not need to be exact and true segments of circular cross section. In other embodiments, it may consist of an asymmetrical spline cross section, so long as the portion beneath the larger strings is more highly curved than the portion beneath the smaller strings.

While the foregoing is directed to embodiments of the present invention, other and further embodiments of the invention may be devised without departing from the basic scope thereof, and the scope thereof is determined by the claims that follow.

The invention claimed is:

1. A stringed instrument comprising:

A body;

an elongate neck;

a headstock;

wherein the neck includes a fingerboard, the fingerboard having fixed, spaced-apart frets disposed perpendicularly along its length and extending from a first to a second side of the fingerboard, a top surface of the frets forming a fret plane, the fret plane having a first and second convex radiused surfaces, the first surface extending from an upper edge of the plane towards a center thereof and the second surface extending from a lower edge of the plane to a center thereof; and wherein the first surface forms a smaller radius and the second surface forms a larger radius.

2. The stringed instrument of claim 1, wherein the surface of the fingerboard has corresponding first and second surfaces.

3. The stringed instrument of claim 2, wherein the instrument includes a plurality of strings arranged side-by-side along the length of the fingerboard and forming a string plane, the string plane including corresponding first and second surfaces.

4. The stringed instrument of claim 3, wherein the strings are constructed and arranged to be depressed between frets.

5. The stringed instrument of claim 4, wherein the strings are suspended at a first end by a nut and at a second end by a saddle, the strings in their unfretted position increasing in height between the nut and the saddle.

6. The stringed instrument of claim 5, wherein the instrument includes 6 strings and at least the smallest diameter string is displaceable towards a centerline of the fretboard.

7. The stringed instrument of claim 6, wherein the instrument is a guitar.

8. The stringed instrument of claim 7, wherein the instrument is an acoustic guitar.

9. The stringed instrument of claim 8, wherein a top of the guitar acts as an acoustic soundboard.

10. The stringed instrument of claim 7, wherein the instrument is an electric guitar.

11. The stringed instrument of claim 1, wherein the first smaller convex radius is a radius measuring about 10 inches and the second larger convex radius is a radius measuring about 15 inches.

12. A guitar, comprising:

an elongate fingerboard;

a plurality of frets, each disposed perpendicularly along the fingerboard;

three larger diameter and three smaller diameter spaced-apart strings running the length of the fingerboard, the strings suspended by a nut at a first end and at a first height and suspended by a saddle at a second end and at a second greater height; and an upper surface of the frets forming a fret plane along the length of the fingerboard, the fret plane divided into a first smaller convex radius under the larger strings and a second larger convex radius under the smaller strings, whereby a smaller string, when displaced towards a centerline of the fingerboard will have a smaller rise/run ratio than a larger string displaced towards the centerline.

13. The guitar of claim 12, wherein the size of the first smaller convex radius is about ⅔rds the size of the second larger convex radius.

14. The guitar or claim 12, wherein the first smaller convex radius is a radius measuring about 10 inches and the second larger convex radius is a radius measuring about 15 inches.

* * * * *